United States Patent [19]

Smith

[11] Patent Number: 4,909,805

[45] Date of Patent: Mar. 20, 1990

[54] TEXTILE TREATMENT

[75] Inventor: Geoffrey W. Smith, Birmingham, England

[73] Assignee: Albright & Wilson Limited, Warley, West Midlands, England

[21] Appl. No.: 202,717

[22] Filed: Jun. 3, 1988

[30] Foreign Application Priority Data

Jun. 5, 1987 [GB] United Kingdom ..... 8713224

[51] Int. Cl.[4] ..... D06M 1/02; 8 127.1; 8 181; 8 490; 427 341; 427 342; 427 393.3

[52] U.S. Cl. ..... 8/127.1; 8/181; 8/490; 427/341; 427/342; 427/393.3

[58] Field of Search ..... 8/127.1, 181, 490; 422/341, 342, 393.3

[56] References Cited

U.S. PATENT DOCUMENTS 4,154,890 5/1979 Wagner ..... 428/276
4,156,747 5/1979 Wagner ..... 427/341
4,451,262 5/1984 Mayer et al. ..... 8/490 X
4,483,689 11/1984 Welch ..... 8/194 X
4,494,951 1/1985 Cole et al. ..... 427/241 X

OTHER PUBLICATIONS

American Dyestuff Reporter "How to Apply THPOH Fire Retardant", By Francis J. Quinn, May 1974, pp. 24–29.

*Primary Examiner*—Michael Lusignan
*Attorney, Agent, or Firm*—Frishauf, Holtz, Goodman & Woodward

[57] ABSTRACT

A process for flame retarding blends of cellulosic and other fibres e.g. polyester fibres involves impregnation thereof with tetra kis (hydroxyorgano) phosphonium compounds or condensates thereof followed by curing with ammonia, the operation being performed in at least two steps, and with 5–20% of organophosphorus compound (as THP+ ion) applied in the first step.

23 Claims, No Drawings

TEXTILE TREATMENT

This invention concerns the flame retardant treatment of textile materials.

The flame retardant treatment of cotton fabric with tetra kis (hydroxymethyl) phosphonium compounds or precondensates thereof with urea has been described in U.S. Pat. Nos. 2,983,623, 4,068,026, 4,078,101, 4,145,463 and 4,494,951. The treatment processes involved impregnation of the fabric with an aqueous solution of the chemicals, followed by drying, treatment with ammonia to cure the phosphorus compounds in order to insolubilize the phosphorus onto the fabric, finally with oxidation and washing to leave a treated fabric whose flame resistance is retained even after many washes in use.

When the process is applied to cotton blends e.g. cotton polyester blends, it has been found that the cure efficiency, which is a measure of the effectiveness of the cure in insolubilizing the phosphorus, is reduced. We have discovered how to increase the cure efficiency with cotton blends, e.g. cotton polyester blends.

The present invention provides a process for flame retardant treatment of a substrate comprising fibres, which are blends of cellulosic fibres and other fibres (e.g. ones coblendable therewith), which process comprises in step (a) impregnation of said substrate with an aqueous solution of an organo phosphorus compound, which is a tetra kis (hydroxyorgano) phosphonium compound especially a tetra kis (hydroxymethyl) phosphonium compound (hereafter called a "THP" compound) or a water soluble condensate thereof with an organic nitrogen containing compound, or a mixture of said phosphonium compound and said organic nitrogen compound, to provide an impregnated substrate carrying 5–20% organo phosphorus material (expressed as THP ion and based on the original weight of the substrate), drying the impregnated substrate so obtained, and treating the dried impregnated substrate with ammonia to cure the organo phosphorus compound to give a treated substrate, and then in step (b) reimpregnating the treated substrate with an organo phosphorus compound, which is a tetra kis (hydroxyorgano) phosphonium compound, especially a THP compound or condensate thereof with an organic nitrogen compound or mixture of said phosphonium compound and said nitrogen compound, drying the impregnated substrate so obtained and treating the dried substrate with ammonia to cure the organo phosphorus compound to give a cured substrate.

In the tetra (hydroxyorgano) phosphonium compound, each hydroxyorgano group is preferably an alpha hydroxyorgano group of 1–9 carbons especially one of formula HOC—($R^1R^2$)—wherein each of $R^1$ and $R^2$ which is the same or different represents hydrogen or an alkyl group of 1 to 4 carbons e.g. methyl or ethyl. Preferably $R^1$ is hydrogen and especially e.g. both $R^1$ and $R^2$ are hydrogen as in tetra kis (hydroxymethyl) phosphonium (THP) compounds. The use of tetra hydroxyorgano phosphonium compounds in general will hereafter be exemplified with respect to THP compounds with corresponding molar amounts of the other compounds used instead of the THP compound.

The non cellulosic fibres are preferably polyester or polyamide fibres but may also be acrylic especially modacrylic fibres. The Polyamide may be an aliphatic one, such as copolymers of alkylene diamines and alkylene dicarboxylic acids e.g. nylon 66 or polylactams such as nylon 6, or may be an aromatic one, such as aramids based on aromatic dicarboxylic acids and phenylene diamines. The substrate can contain at least 30% of cellulosic fibres and up to 70% of the coblendable fibres e.g. 10–70% and especially 25–60% of coblendable fibres such as polyamides. However preferably the substrate comprises cellulosic fibres and polyester fibres. The substrate usually contains up to 70% e.g. up to 60% of polyester fibres and from 30% e.g. from 40% upwards of cellulosic fibres e.g. 1–70% or 1–60%, such as 5–55% or 15–60%, particularly 15–30% or 22–38% or 38–60% polyester fibres and 30–99% or 40–99% such as 45–95% or 40–85%, particularly 70–85% or 62–78% or 40–62% cellulosic fibres. Substrates comprising 40–78% cellulosic fibres and 22–60% polyester fibres or 30–62% cellulosic fibres and 38–70% polyester fibres are preferred. The cellulosic fibres are preferably natural cotton, buy may be ramie flax or regenerated fibres e.g. viscose or cuprammonium fibres. The polyester is usually a condensation product containing structural units from an aliphatic alcohol e.g. a dihydric alcohol especially ethylene glycol and an aromatic dicarboxylic acid e.g. terephthalic acid.

The substrate fibres may be in the form of thread or non woven fabric, but are preferably as woven fabric. The cellulosic and other fibres may be an intimate or non intimate mixture but the fibres are preferably in the form of a blend of cellulosic fibres and the other fibres e.g. polyester fibres, as in a cospun blend such as cotton polyester staple fibre, but may be in the form of core spun yarn with a core of the other fibre e.g. polyester sheathed in cotton fibres. In a fabric, the warp and weft fibres are preferably the same, but may be different e.g. one may be from cotton fibres and the other from e.g. polyester cotton fibres. Thus in this specification the term "blend" also includes unions and union/blends as well as core sheath fibres. The substrate is preferably a fabric with a weight of 100–1000 g/m$^2$ e.g. 150–400 g/m$^2$, such as cotton polyester shirting or sheeting or curtain fabric.

The impregnation solution is an aqueous solution of a THP salt mixed with a nitrogen compound condensable therewith such as melamine or methylolated melamine or urea, or a solution of a precondensate of said salt and nitrogen compound, or a solution of THP salt or at least partly neutralized THP salt, e.g. THP hydroxide, with or without the nitrogen compound.

The solution preferably contains a precondensate of THP salt, e.g. chloride or sulphate and urea in a molar ratio of urea to THP of 0.05–0.8:1, e.g. 0.05–0.6:1, such as 0.05–0.35:1 or 0.35–0.6:1, and usually has a pH of 4–6.5 e.g. 4–5.

In step (a), the concentration of organophosphorus compound in the aqueous solution may be 5–35% (expressed by weight as THP+ ion), e.g. 25–35%, but is preferably less than 25%, usually 5–25% e.g. 10–22% such as 10–15% or 15–22%. In step (b) the concentration of organo phosphorus compound in the aqueous solution may also be 5–35% (expressed by weight as THP+ ion) such as 25–35% but preferably the concentration is also less than 25%, e.g. 5–25% such as 10–22% and especially 10–15% or 15–22%.

Usually the concentration of organophosphorus compound (as THP ion) is less than 25% in at least one of steps (a) and (b) and preferably at least step (a) and especially both steps. Most conveniently the substrate is impregnated by contact with an impregnation bath containing the aqueous solution containing 5–25% organophosphorus compound in step (a) and then reimpregnated through the same solution in step (b).

If desired the solution may contain a wetting agent such as a nonionic or anionic one.

The substrate is impregnated in step (a) with the solution and the wet fabric usually squeezed to a wet pick up of 50–130%, e.g. 60–100% (based on the original weight of the substrate) in the case of solutions with less than 25% organophosphorus compound (as THP ion). For solutions with 25–35% organophosphorus compound (as THP ion), extra squeezing or a minimum add-on technique may be used to give a wet pick up of 30–50%. The substrate after impregnation usually has an organo phosphorus pick up of less than 20% e.g. 5–20% such as 5–15% especially 10–15% (as THP ion based on the original weight of the substrate). The impregnated substrate is then dried e.g. to a moisture content of 0–20%, e.g. 5–15%, such as about 10%, the percentage being derived from the increase in weight of the fabric and the weight of chemicals impregnated. The drying may be in a stenter oven or over heated cans e.g. steam cans and may involve heating at 80°–120° C. for 10 to 1 min. The dried substrate is then cured by treatment with ammonia, usually gaseous ammonia, which diffuses through the substrate and/or is forced through the substrate e.g. by passage of the fabric over a perforated tube through which ammonia gas is emitted. Examples of apparatus and techniques suitable for the ammonia cure are given in U.S. Pat. Nos. 4145463, 4068026 and 4494951.

After step (a) the treated substrate usually has a resin add-on of 5–20% e.g. 8–15% especially 10–15%, (by weight of the original substrate).

The treated substrate from step (a) may be reimpregnated directly in step (b). But in order to reduce any effect of residues in the substrate from step (a) affecting the impregnation and/or the impregnation liquid in (b) affecting the cured resin from (a), it is usually preferred to perform an intermediate step involving at least one of the following operations: further insolubilization of the cured resin in the treated substrate from (a), oxidation in order to convert at least some trivalent phosphorus to pentavalent phosphorus in the cured resin, washing with aqueous base and washing with water. The oxidation is preferably by contact with an aqueous solution of an oxidizing agent, preferably a peroxy compound, such as aqueous hydrogen peroxide solution e.g. of 0.5–10% concentration such as 1–5% strength or sodium perborate solution e.g. of 1–10% concentration usually applied in excess and usually for 0.1–10 mins at 0°–40° C. Alternatively the oxidation may be performed with a gas containing molecular oxygen, preferably air, and particularly with the gas being drawn or blown through the substrate; thus the substrate in the form of fabric can be passed over a vacuum slot or perforated tube through which the gas is blown or sucked.

After the oxidation, or instead thereof, the treated substrate may be washed with an aqueous medium, preferably an aqueous solution of base, e.g. sodium carbonate solution and/or rinsed with water. The oxidation preferably reduces the residual content of formaldehyde on the treated substrate. Alternatively the treated substrate may simply be rinsed with water or submitted to other operations to reduce its content of water soluble materials.

If the treated substrate has been wetted during the intermediate treatment e.g. during aqueous solution oxidation, then it is preferably dried e.g. to 0–10% moisture content, though drying may be omitted. The treated fabric is then submitted to the processes of step (b) with impregnation, drying, curing, as described above to give a cured substrate. The operation of step (b) usually provides a further organophosphorus pick up of less than 20% e.g. 5–20% such as 5–15% and especially 10–15% (expressed as THP ion based on the original weight of the substrate). The total of organophosphorus compound pick up in steps (a) and (b) is usually 16–36% e.g. 20–28% (expressed as THP ion, on the same basis). The ammonia curing in step (a) and (b) which occurs at less than 100° C. cures the applied organophosphorus compounds to a very significant extent e.g. at least 75%. After the ammonia curing the cured substrate is then usually submitted to oxidation, and washing as described above. If desired the process of step (b) can be repeated one or more times, preferably with intermediate oxidation and washing as described above; triple or quadruple treatments may be beneficial with substrates having higher proportions of other fibres to cellulosic ones and impregnation with dilute organophosphorus solutions. Finally the cured substrate is dried but prolonged heating of dry cured substrate at above 100° C. e.g. 100°–150° C. to effect thermal cure rather than ammonia cure is avoided. The cured substrate usually has a total resin add-on of 15–30%, e.g. 20–27% (by weight based on the original weight of the substrate) and especially for fabrics of 150–400 g/m$^2$ with 22–70% polyester and 30–78% cotton fibres. Conveniently 20–85% especially 30–70% of the phosphorus is applied in step (a) and 80–15% especially 70–30% in step (b).

The cured substrate e.g. fabric can be used for making workwear such as overalls, boiler suits and protective clothing including uniforms, particularly from 30–70% e.g. 55–70% cotton and 70–30% e.g. 45–30% polyester, and household fabrics such as sheets and curtains particularly from 45–70% e.g. 45–55% cotton and 55–45% polyester.

For a constant total weight of phosphorus chemical applied to the substrate, the cured substrate after step (b) of the invention, particularly when in steps (a) and (b) the concentration of organo phosphorus compound in the aqueous solution is 5–25% (as THP ion), and there is intermediate oxidation between steps (a) and (b), usually has a higher percentage of bound phosphorus and may have a better handle than cured substrate from a single step impregnation with concentrated impregnant solution, drying and curing with ammonia. There may thus be less wastage of phosphorus chemical.

The cured substrate obtained by the process of the invention may also have enough cured and bound resin to enable it to reach the most exacting flame retardancy standards e.g. BS3120, which may not be passed by the same original substrate cured after treatment in one step with the concentrated impregnant solution drying and curing with ammonia. The cured substrate obtained by the process of the invention may also have improved handle and less reduction in strength compared to corresponding substrates in which the curing involves heat curing above 100° C.

The process is illustrated in the following Examples.

General Treatment Method

For use in the Examples, each fabric was a workwear fabric from co-spun cotton polyester blends and was first enzymatically desized and scoured with alkali and washed. The fabrics were then impregnated to an about 55–95% wet pick-up with an aqueous solution at pH 4.5 of a precondensate of THP chloride and urea in a molar ratio of 1:0.5; the solutions contained condensate in amount corresponding to 20.2 or 13.8% THP ion in Ex. 1–5 and 34.3 or 27.2% THP ion in Comparative Ex. A–E. The impregnated fabric was then dried for 4 minutes in an oven at 100° C. and then cured with gaseous ammonia in a forced gas ammoniator as described in U.S. Pat. No. 4,145,463. The cured fabric was then padded with an about 3% aqueous hydrogen peroxide solution at room temperature and allowed to stand for about 1 minute, neutralized with sodium carbonate solution, rinsed with water and redried under the same conditions to give a treated fabric. The fabric was weighed to give the resin add-on after cure.

In the case of Ex. 3–5, the treated fabric from the above process step (a) was reimpregnated in step (b) with the same solution, dried, ammonia cured, oxidized, neutralized, rinsed and dried as before. The fabric was then reweighed. The same extra procedure was also adopted for Ex 1 and 2 apart from use of a more dilute impregnation bath containing an amount of condensate equivalent to 18.2% THP ion.

The fabrics obtained after the 2 step process of Ex. 1–5 and the 1 step process of Comp. Ex. A–E were then tested for flame retardancy before and after washing 40 times at 93° C., the washing being as in the manner described in DIN 53920 procedure 1 with soft water. The test method used was according to BS 3119 and the char length was determined.

The results were as given in Table 1. The resin add-ons are given as a percentage of the original fabric weight, i.e. at the start of step (a). The results show that 2 step treatment with a dilute THP bath gives much better results than 1 step treatment with a concentrated THP bath.

EXAMPLES 6–11

The processes of Examples 1–5 were repeated with other fabrics and other THP concentrations in the baths in step (a) and (b).

The results were as given in Tables 2 and 3.

TABLE 1

| Example | Results 1 | Results 2 | 3 | 4 | 5 |
|---|---|---|---|---|---|
| Fabric | Olive Green Dyed Drill | Lime Green Dyed Satin | Drill | Drill | Drill |
| Blend of Cotton to Polyester by wt. | 50/50 | 50/50 | 70/30 | 65/35 | 55/45 |
| Weight g/m$^2$ | 225 | 300 | 240 | 238 | 233 |
| Step (a) | | | | | |
| % THP$^+$ ion in Bath | 20.2 | 20.2 | 13.8 | 13.8 | 13.8 |
| % Wet Pick-up (a) | 63.8 | 59.6 | 87.8 | 88.0 | 88.0 |
| % THP$^+$ Pick-up (a) | 12.9 | 12.0 | 12.1 | 12.1 | 12.1 |
| % Resin Add-on (a) | 12.9 | 11.9 | 11.8 | 12.1 | 12.1 |
| Step (b) | | | | | |
| % THP$^+$ ion in Bath | 18.2 | 18.2 | 13.8 | 13.8 | 13.8 |
| % Wet Pick-up (b) | 61.2 | 57.9 | 97.0 | 93.4 | 97.9 |
| % THP$^+$ Pick-up (b) | 11.1 | 10.5 | 13.4 | 12.9 | 13.5 |
| % Resin Add-on (b) | 11.8 | 11.8 | 12.1 | 11.7 | 12.5 |
| Total in (a) + (b) THP$^+$ Pick-up | 24.0 | 22.5 | 25.5 | 25.0 | 25.6 |
| Total % Resin add on a + b | 24.7 | 23.7 | 23.9 | 23.8 24.6 | |
| Char Length mm | | | | | |
| BS3119 As finished | 82 | 72 | 65 | 72 | 76 |

TABLE 1-continued

| Example | Results 1 | Results 2 | 3 | 4 | 5 |
|---|---|---|---|---|---|
| Fabric | Olive Green Dyed Drill | Lime Green Dyed Satin | Drill | Drill | Drill |
| After 40 washes | 95 | 80 | 70 | 70 | 75 |
| Comparative Ex. | A | B | C | D | E |
| % THP$^+$ ion in bath | 34.3 | 34.3 | 27.2 | 27.2 | 27.2 |
| % Wet Pick-up | 65.2 | 61.2 | 83.4 | 82.8 | 85.2 |
| % THP$^+$ Pick-up | 22.4 | 21.0 | 22.7 | 22.5 | 23.2 |
| % Resin add-on | 15.2 | 12.2 | 11.0 | 16.7 | 11.9 |
| Char length mm | | | | | |
| BS3119 As finished | Bc | Bc | 94 | Bc | Bc |
| After 40 washes | Bc | Bc | Bc | Bc | Bc |

Bc—Burns completely

TABLE 2

| Example | 6 | 7 |
|---|---|---|
| Fabric | Drill | Drill |
| Blend of Cotton To Polyester by weight | 55/45 | 75/25 |
| Weight g/m$^2$ | 260 | 260 |
| Step (a) | | |
| % THP$^+$ bath strength | 17.6 | 15.1 |
| % Wet Pick-Up | 62 | 74 |
| % THP$^+$ Pick-Up | 10.9 | 11.2 |
| Step (b) | | |
| % THP$^+$ bath strength | 21.2 | 18.6 |
| % Wet Pick-Up | 53 | 60 |
| % THP$^+$ Pick-UP | 11.2 | 11.2 |
| Step (a) + (b) | | |
| % Total THP$^+$ Pick-Up | 22.1 | 22.4 |
| % P as finished | 3.60 | 3.46 |
| Flammability | Pass | Pass |

NOTE
*Flammability test was DIN 66083 Class S-b on fabric after 40 washes at 93° C.

TABLE 3

| Example | 8 | 9 | 10 | 11 |
|---|---|---|---|---|
| Fabric | Sheeting | Drill | Drill | Drill |
| Blend of Cotton to Polyester by Weight | 50/50 | 33/67 | 65/35 | 60/40 |
| Weight g/m$^2$ | 160 | 230 | 270 | 350 |
| Step (a) | | | | |
| % THP$^+$ Bath Strength | 17.1 | 17.6 | 12.6 | 14.6 |
| % Wet Pick-up | 65 | 62 | 88 | 76 |
| % THP$^+$ Pick-up | 11.1 | 10.9 | 11.1 | 11.1 |
| Step (b) | | | | |
| % THP$^+$ Bath Strength | 17.6 | 18.1 | 13.1 | 14.6 |
| % Wet Pick-up | 63 | 60 | 86 | 75 |
| % THP Pick-up | 11.1 | 10.9 | 11.3 | 11.0 |
| Step (a) + (b) | | | | |
| Total % THP$^+$ Pick-Up | 22.2 | 21.8 | 22.4 | 22.1 |
| % P as finished | 3.18 | 3.35 | 2.93 | 3.07 |
| FLAMMABILITY STANDARD | | | | |
| BS3120 | D | A | C | C |
| BS6249 Index (B) | NT | C | C | C |
| AFNOR G07-184 Class (B) | NT | B | C | C |

NOTE
*N.T. means Not Tested.
Flammability Standard results are quoted in terms of 4 grades, according to the fabric which passes the appropriate test, whether (A) as finished, (B) after 12 washes at 93° C., (C) after 50 washes at 93° C. or (D) after 200 washes at 74° C. The 93° wash test was by the Procedure of DIN 53920, while the 74° C. wash was by BS5651 Procedure 7.5.4.

Flammability Standard results are quoted in terms of 4 grades, according to the fabric which passes the appropriate test, whether (A) as finished, (B) after 12 washes at 93° C., (C) after 50 washes at 93° C. or (D) after 200 washes at 74° C. The 93° wash test was by the Procedure of DIN 53920, while the 74° C. wash was by BS5651 Procedure 7.5.4.

EXAMPLES 12–15 AND COMPARATIVE EXAMPLE F.

The processes of Examples 1–5 were repeated with a 50/50 polyester cotton drill fabric of 174 g/m² weight and substantially constant total THP ion uptake but variable proportions between steps (a) and (b). The drying time was 1 min at 90° C.

The results were as given in Table 4.

TABLE 4

| | Results | | | | |
|---|---|---|---|---|---|
| Example | 12 | 13 | 14 | 15 | Comparative F |
| Step (a) | | | | | |
| % THP+ in Bath | 10 | 15 | 20 | 25 | 30 |
| % THP+ Pick-up | 5.8 | 9.0 | 12.3 | 15.9 | 19.8 |
| % THP+ Cured Resin add-on | 3.3 | 6.6 | 8.6 | 9.1 | 9.2 |
| Step (b) | | | | | |
| % THP+ in Bath | 20 | 15 | 10 | 5 | — |
| % THP+ Pick-up | 14.4 | 11.1 | 7.5 | 3.7 | — |
| % Resin add on | 8.9 | 7.8 | 5.6 | 2.9 | — |
| Step (a) + (b) | | | | | |
| Total % THP+ Pick-Up | 20.2 | 20.1 | 19.8 | 19.6 | 19.8 |
| % Resin add on | 12.2 | 14.4 | 14.2 | 12.0 | 9.2 |

I claim:

1. A process for flame retardant treatment of a substrate comprising fibres, which are blends of cellulosic fibres and other fibres, which process comprises in step (a) impregnation of said substrate with an aqueous solution of an organo phosphorus compound, which is a tetra kis (hydroxyorgano) phosphonium compound or a water soluble condensate thereof with an organic nitrogen containing compound, or a mixture of said phosphonium compound and said organic nitrogen compound, to provide an impregnated substrate carrying 5–20% organo phosphorus material (expressed as tetra kis (hydroxymethyl) phosphonium ion (hereafter called a THP ion) and based in the original weight of the substrate) drying the impregnated substrate so obtained, and treating the dried impregnated substrate with ammonia to cure the organo phosphorus compound to give a treated substrate, and then in step (b) reimpregnating the treated substrate with an organo phosphorus compound, which is a tetra kis (hydroxyorgano) phosphonium compound or condensate thereof with an organic nitrogen compound or mixture of said phosphonium compound and said nitrogen compound, drying the impregnated substrate so obtained and treating the dried substrate with ammonia to cure the organo phosphorus compound to give a cured substrate.

2. A process according to claim 1 wherein the impregnation in step (b) applies to the substrate 5–20% organophosphorus material (expressed by weight as THP ion and based on the original weight of the substrate) to give a cured substrate with a total resin add-on of 15–30% (expressed by weight based on the original weight of the substrate.

3. A Process according to claim 1 or 2 wherein the substrate comprises cellulosic fibres and coblendable fibres which are polyester fibres, polyamide fibres or mixtures thereof.

4. A process according to claim 2 wherein the substrate comprises cellulosic and polyester fibres and the phosphonium compound is a THP compound.

5. A process according to any one of claims 1, 2 or 4 wherein the impregnations in each of steps (a) and (b) apply 5–15% of organophosphorus material (expressed as THP ion) to the substrate.

6. A process according to any one of claims 1, 2 or 4 wherein 30–70% of the phosphorus is applied in step (a) and 70–30% in step (b).

7. A process according to any one of claims 1, 2 or 4 wherein in step (a) the substrate is treated with an aqueous solution containing less than 25% by weight of organophosphorus compound (expressed as THP ion).

8. A process according to claim 7 wherein in steps (a) and (b) the substrate is treated with aqueous solutions which contain 10–22% by weight of organophosphorus compound (expressed as THP ion).

9. A process according to any one of claims 1, 2 or 4 wherein the treated substrate from step (a) is oxidized to convert at least some trivalent phosphorus to pentavalent phosphorus before reimpregnation in step (b).

10. A process according to claim 9 wherein after oxidation the substrate is washed with an aqueous medium and dried before step (b).

11. A process according to any one of claim 1, 2 or 4 wherein the cured substrate from step (b) is oxidized to convert at least some trivalent phosphorus to pentavalent phosphorus.

12. A process according to claim 9 wherein the oxidation is performed with aqueous hydrogenperoxide solution.

13. A process according to any one of claims 1, 2 or 4 wherein the organo phosphorus compound is a condensation of urea and a THP salt in a molar ratio of urea to THP ion of 0.05–0.6:1.

14. A process according to any one of claims 1, 2 or 4 wherein the ammonia curing is performed by forcing gaseous ammonia through the substrate.

15. A process according to claim 4 wherein the substrate is a fabric of 40–78% cellulosic fibres and 22–60% polyester fibres.

16. A process according to claim 4 wherein the substrate is a fabric of 30–62% cellulosic fibres and 38–70% polyester fibres.

17. A process according to claim 4 wherein the impregnations in each of steps (a) and (b) apply 5–15% of organophosphorus material (expressed as THP ion) to the substrate, and wherein in steps (a) and (b) the substrate is treated with aqueous solutions which contain 10–22% by weight of organophosphorus compund (expressed as THP ion).

18. A process according to claim 17 wherein the treated substrate from step (a) is oxidized to convert at least some trivalent phosphorus to pentavalent phosphorus before reimpregnation in step (b).

19. A process according to claim 17 or 18 wherein the cured substrate from step (b) is oxidized to convert at least some trivalent phosphorus to pentavalent phosphorus.

20. A process according to claim 1 or 15 wherein a fabric of a blend of 40–78% cotton and 22–60% polyester fibres is impregnated in step (a), with an aqueous solution of a condensate of urea and a THP salt in a mole ratio of urea to THP ion of 0.05–0.6:1, the solution containing 10–22% of the organo phosphorus material (expressed by weight as THP ion) to give an impregnated substrate carrying 5–15% organo phosphorus material (expressed as THP ion), followed by drying, curing with gaseous ammonia, then oxidation to convert at least some trivalent phosphorus to pentavalent phosphorus, and washing and drying, to give a cured fabric followed in step (b), by impregnation of the cured fabric with an aqueous solution of a condensate of urea and a THP salt in a mole ratio of urea to the THP ion of 0.05–0.6:1, the solution containing 10–22% of the organo phosphorus material (expressed an THP ion) to give an impregnated substrate carrying a further 5–15% of organo phosphorus material (expressed as THP ion), followed by drying, curing with gaseous ammonia, then oxidation to convert at least some trivalent phosphorus to pentavalent phosphorus, and washing and drying to give a cured substrate, the total of organo phosphorus compound pick up in steps (a) and (b) being 20–28% (expressed as THP ion) and 30–70% of the phosphorus being applied in step (a), and 70–30% in step (b), and the total resin add on being 20–27%.

21. A process according to claim 1 wherein said substrate comprising fibres is a cospun blend of cellulosic fibres and other fibres.

22. A process according to claim 1 wherein said substrate comprising fibres is a blend of fibres having a core of at least one of cellulosic fibres and other fibres and a sheath which is different than the core.

23. A process according to claim 1 wherein said substrate comprising a fabric which is a woven fabric with the warp fibres of at least one of said cellulosic fibres and other fibres and the weft of at least one of said cellulosic and other fibres, provided that at least one of the warp and the weft fibres are cellulosic fibres and said other fibres are selected from fibres other than celluosic fibres.

* * * * *